United States Patent [19]

Hergeth

[11] Patent Number: 4,687,147

[45] Date of Patent: Aug. 18, 1987

[54] FIBER-BALE MILL

[76] Inventor: Hubert A. Hergeth, Kockerellstrasse 3, 5100 Aachen, Fed. Rep. of Germany

[21] Appl. No.: 821,995

[22] Filed: Jan. 24, 1986

[30] Foreign Application Priority Data

Feb. 2, 1985 [DE] Fed. Rep. of Germany ..... 3503522

[51] Int. Cl.[4] ..... D01G 7/04; D01G 7/06

[52] U.S. Cl. ..... 241/101 A; 19/80 R

[58] Field of Search ..... 241/101 A; 19/80 R, 19/80 A

[56] References Cited

U.S. PATENT DOCUMENTS

| | | | |
|---|---|---|---|
| 4,467,502 | 8/1984 | Lytton et al. | 241/101 A X |
| 4,507,826 | 4/1985 | Keller et al. | 19/80 R |
| 4,510,646 | 4/1985 | Locatelli et al. | 19/80 R |
| 4,595,149 | 6/1986 | Hergeth | 241/101 A |

*Primary Examiner*—Frank T. Yost

*Attorney, Agent, or Firm*—Karl F. Ross; Herbert Dubno

[57] ABSTRACT

A cutting mechanism for an apparatus for cutting and mixing fibers from a plurality of fiber bales arranged in a row includes a grid between the fiber bales and a cutting member having at least one cutter roller mounted at one of its ends, wherein the grid surrounds the cutting member at least up to the height of the axis of each of the cutter rollers provided.

7 Claims, 4 Drawing Figures

FIBER-BALE MILL

FIELD OF THE INVENTION

My invention relates to a fiber-bale mill that is a device for plucking fiber bales mounted in a row into fibers or fiber tufts by a milling cutter member traveling over said row.

BACKGROUND OF THE INVENTION

A known fiber-bale mill may comprise a milling cutter member which travels to and fro over a row of fiber bales and a fixed collector for collecting said fibers. The cutting member comprises at least one cutter roller, and an air passage through which the fibers cut are drawn pneumatically into said collector.

It is known to provide a grid through which the fibers from the upper surface of the fiber bale can reach the cutter roller, and which is inclined to the horizontal and leads in the region under the axis of the cutter roller, in order to press the fibers under the cutter roller.

With this cutter mechanism, rows of fiber bales can be cut, only if their top sides lie in a plane, that is, they must be of the same height. If the fiber bales to be cut have different heights, which occurs most commonly when fibers of bales from different sources are to be mixed, then the height of the cutting device must be changed or the higher fiber bale must be reduced to the height of the lower fiber bale by removal of the excess fiber.

OBJECTS OF THE INVENTION

It is an object of my invention to improve fiber bale pluckers so that fibers can be cut continuously from bales mounted in a row having different heights.

SUMMARY OF THE INVENTION

This object is attained in accordance with my invention by providing a grid which surrounds the cutter member up to at least the height of the axis of the cutter roller. By surrounding the cutter member with a grid according to my invention, fiber bales of differing heights, mounted in a row, can be automatically cut by the cutter member. By this means lower fiber bales standing in a gap between two higher fiber bales can be cut, until the cutting member abuts on the lateral surface of a higher fiber bale and it can also cut fiber bales mounted between woodlike supports. Feed rollers, which are commonly used in prior art structures, can be eliminated, when the structure according to my invention is employed.

In a preferred embodiment of my invention the outer boundary of the grid is substantially concentric to the outer working periphery of the cutter roller or rollers and varies from the diameter thereof by at most 6 mm, i.e. is 6 mm larger or 6 mm smaller than the diameter of the cutter roller. In the latter case the cutters can pass through the grid.

Advantageously the grid may extend above the height of the axis or axes of the cutter roller or rollers.

BRIEF DESCRIPTION OF THE DRAWING

The above and other objects, features, and advantages of my present invention will become more readily apparent from the following specific description, reference being made to the accompanying highly diagrammatic drawing in which.

SPECIFIC DESCRIPTION

Figure 1:
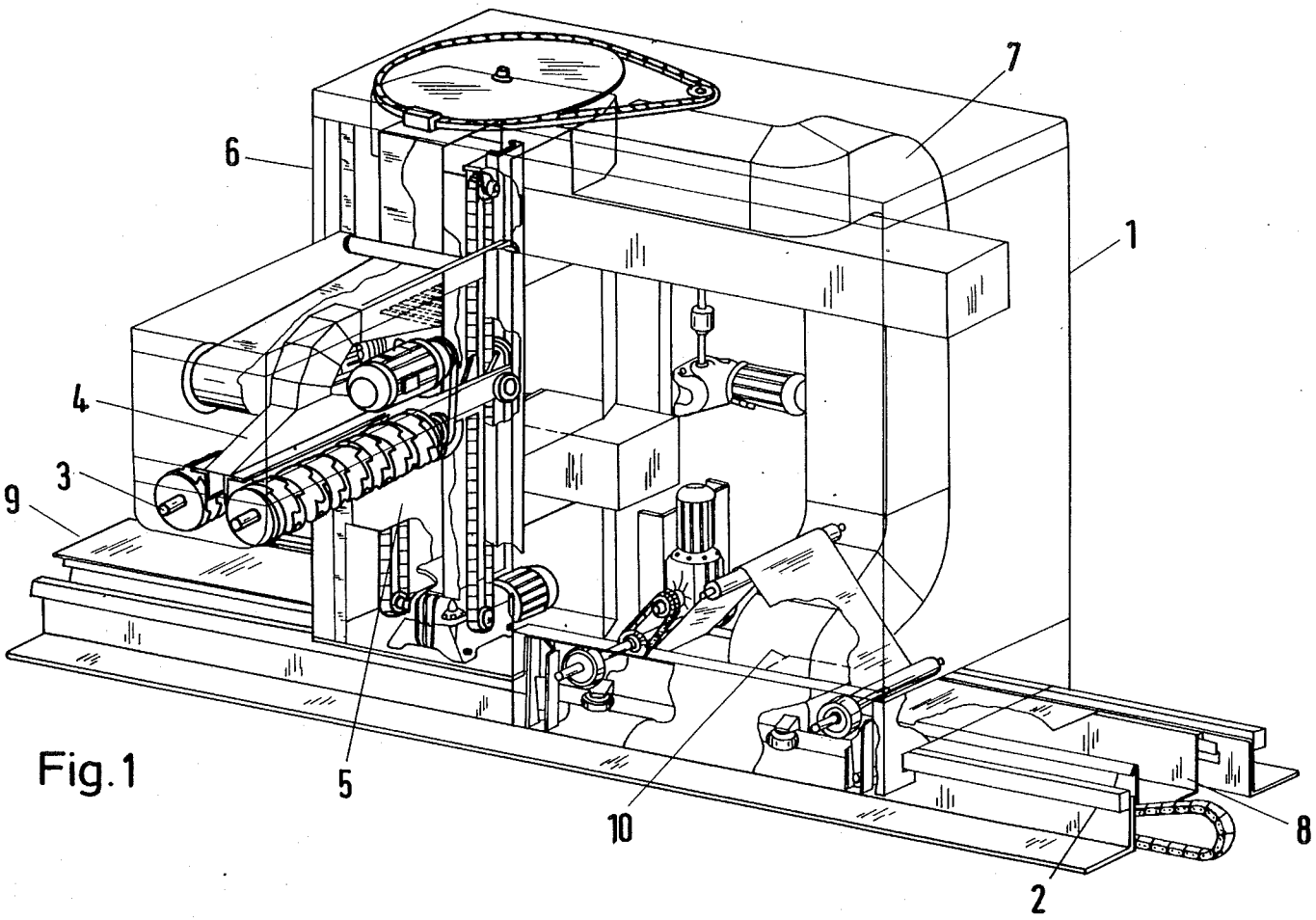
FIG. 1 is a perspecive view of an apparatus for cutting fibers from fiber bales according to my invention but in which the grid has been removed.
Figure 1A:
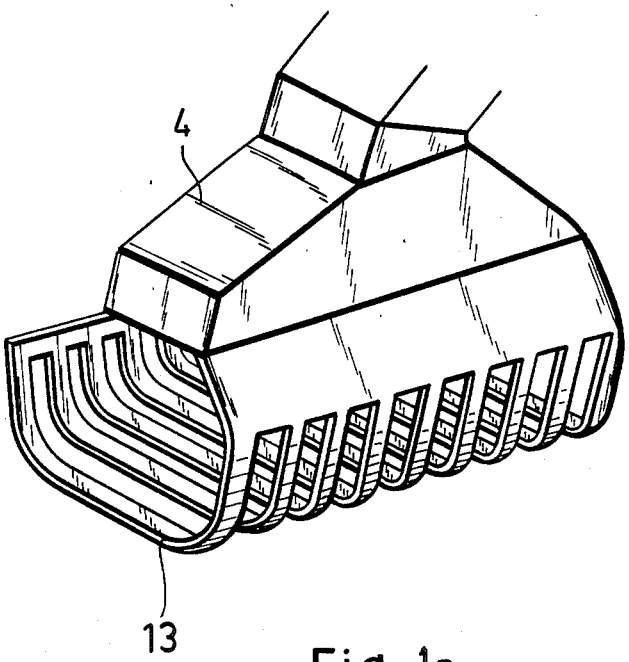
FIG. 1*a* is a perspective view of said grid.
Figure 2:
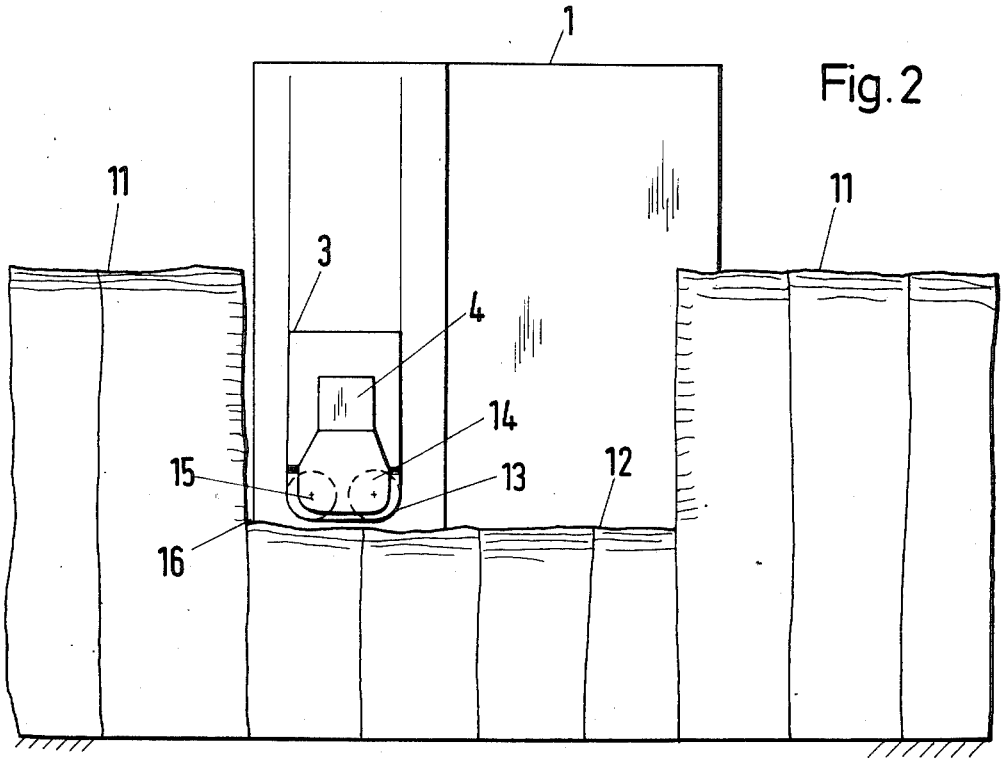
FIG. 2 is a cross sectional view through the cutting member comprising two cutter rollers surrounded by a grid according to my invention.

The cutting device depicted in FIG. 1 comprises a frame 1 traveling on two parallel rails 2 along a row of fiber bales 11 and 12 shown in FIG. 2. The frame 1 has rollers 22 and 23 resting on said rails 2; the rollers 22 are drivable by a motor 20 by means of a chain 21. A casing member 6 is connected to the frame 1 by a vertical axis 30 drivable by a motor 27 by means of a shaft 28 and a chain 29 to turn the casing member to the opposite side of the rails to allow cutting of bales mounted on the other side of the rails 2. The casing member 6 is movable on the frame 1 vertically by a motor 24 by means of chains 25. At the casing member a cutting device is provided consisting of two milling rollers 3 rotatable on parallel axes drivable by a motor 31 by means of chains 25.

Fibers are cut and released from the fiber bales 11 and 12 by said cutting member 3. The fibers which may form fiber tufts are sucked away through an inlet funnel 4 and then pulled through a first air duct 5 of the casing member 6 into a second air duct 7 provided at said frame 1. The second air duct opens into a collector passage 8, which is connected to a vacuum source.

The open top of the collector passage 8 is sealed by a cover strip 9, each end of which is attached to an end of the collector passage 8. The mouth 10 of a second air duct 7 facing the collector passage 8 carries a brush border for more effective sealing opposite the collector passage 8.

Figure 3:
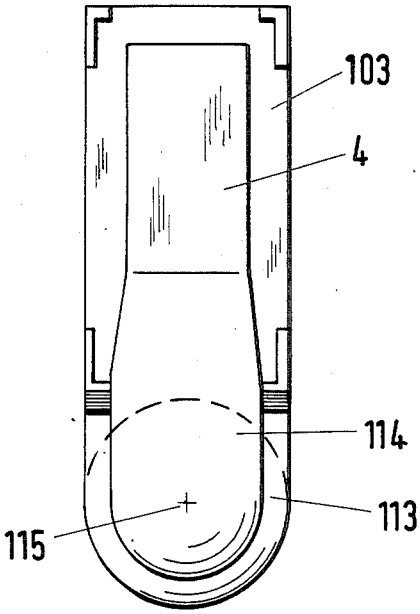
FIG. 3 is a cross sectional view through a cutting member of a second embodiment according to my invention with only a single cutting roller.

FIG. 3 shows the cutting member 3, while it cuts lower fiber bales 12 positioned between higher fiber bales 11. The grid 13 associated with the cutting member 3 adjacent the edge facing the fibers surrounds the contacting peripheral edge of the two cutter rollers 14 so that the outer edge of the grid 13 is flush with the contacting peripheral edge of the cutter rollers 14 or projects outwardly thereof or is recessed inwardly thereof up to 6 mm. It extends above the axes 15 of the rollers 14 vertically. With this structure cutting can proceed until the outer lateral surface of a thicker fiber bale 11 is reached.

FIG. 4 shows a second preferred embodiment of the cutting member 103 according to my invention with only one cutter roller 114. The grid 113 associated with the cutting member 103 below the axis 115 of the cutter roller 114 follows the outer periphery of the cutter roller 114; its diameter may be until 6 mm greater or smaller than the diameter of the roller 114. Above the axis 115 the grid 113 extends vertically

I claim:

1. In a device for plucking fiber bales mounted in a row into fibers or fiber tufts by a milling cutter member traveling over said row and comprising at least one cutter roller, wherein said cutter member is surrounded by a grid up to at least the height of the axis of said cutter roller, said cutting member having only a single roller and said grid is substantially concentric to the outer periphery of said cutter roller below said axis of said cutter roller.

2. The improvement according to claim 1 wherein the spacing of the outer boundary line of said grid from said axis of said cutter roller varies no more than 6 mm from the diameter of the outer periphery of said cutter roller.

3. The improvement according to claim 1 wherein said grid extends up above the height of said axis.

4. In a device for plucking fiber bales mounted in a row into fibers or fiber tufts by a milling cutter member traveling over said row and comprising at least one cutter roller, wherein said cutter member is surrounded by a grid up to at least the height of the axis of said cutter roller, said cutting member having two cutter rollers, said grid being substantially concentric to the outer periphery of said cutter rollers below said axis of said cutter rollers.

5. A cutting mechanism for a fiber-bale mill for cutting fiber from a row of fiber bales comprising a cutting member having at least one cutter roller and a grid surrounding said cutting member up to at least the height of the axis of said cutter roller, said grid being substantially concentric to the outer periphery of said cutter roller below said axis of said cutter roller.

6. The mechanism according to claim 5 wherein said cutting member has a single cutter roller.

7. The mechanism according to claim 5 wherein said cutting member has two equal sized cutting rollers.

* * * * *